US005478073A

United States Patent [19]

Hackman

[11] Patent Number: 5,478,073

[45] Date of Patent: Dec. 26, 1995

[54] GOLF SWING ANALYSIS AND METHOD OF CUSTOM TRIMMING GOLF CLUB SHAFTS

[76] Inventor: Lloyd E. Hackman, 1322 Clubview Blvd. S., Worthington, Ohio 43085

[21] Appl. No.: 307,917

[22] Filed: Sep. 16, 1994

Related U.S. Application Data

[63] Continuation-in-part of Ser. No. 998,662, Dec. 30, 1992, Pat. No. 5,351,952.

[51] Int. Cl.[6] ..... A63B 53/10; A63B 53/12

[52] U.S. Cl. ..... 273/77 A

[58] Field of Search ..... 273/77 A, 80 B

[56] References Cited

U.S. PATENT DOCUMENTS

| | | | |
|---|---|---|---|
| 3,945,646 | 3/1976 | Hammond | 273/186.2 |
| 4,122,593 | 10/1978 | Braly | 273/77 A X |
| 4,555,112 | 11/1985 | Masghati | 273/77 A |
| 4,615,526 | 10/1986 | Yasuda et al. | 273/186.2 x |
| 4,630,829 | 12/1986 | White | 273/186.2 |
| 4,878,672 | 11/1989 | Lukasiewicz | 273/186.2 |
| 4,967,596 | 11/1990 | Rilling et al. | 273/186.2 x |
| 4,991,850 | 2/1991 | Wilhelm | 273/186.2 |
| 5,318,296 | 6/1994 | Adams et al. | 273/77 A |
| 5,351,952 | 10/1994 | Hackman | 273/77 A |
| 5,351,953 | 10/1994 | Mase | 273/77 A |
| 5,379,641 | 1/1995 | Paasivaara et al. | 273/77 A X |

*Primary Examiner*—George J. Marlo

*Attorney, Agent, or Firm*—Frank H. Foster; Kremblas, Foster & Millard

[57] ABSTRACT

A method of custom trimming golf club shafts comprising (i) measuring the frequency of oscillation, $f_c$, of a representative shaft at a plurality of different tipping amounts and effective shaft lengths, (ii) calculating the moment, $m_c$, of the replica shaft for each effective shaft length, (iii) performing a linear regression on the measured frequencies to obtain the coefficients A and B in the form $$f_c = A + C^* \text{tipping amount} + B^* m_c,$$

(iv) selecting an inventory shaft having a known natural frequency, $f_c$, at a selected moment, $m_c$, and (v) calculating the constant $C = f_c - B^* m_c$. The tipping amount is calculated from the equation $$\text{tipping amount} = (f_g - C - B^* m_g) \div A$$

where $m_g$ is the desired moment and $f_g$ is the desired natural frequency of a golfer's finished golf club. A length of the narrow end of the inventory shaft equal to the tipping amount is removed and a length of the grip end of the inventory shaft may also be removed if necessary.

10 Claims, 6 Drawing Sheets

| | | TITANIUM WOOD SHAFT | | | |
|---|---|---|---|---|---|
| TIPPED | | 0 | 0.75 | 1.5 | 2.25 |
| EFFECTIVE LENGTH | MOMENT | | | | |
| 35.5 | 15.85938 | 335.7291 | 340.4955 | 345.262 | 350.0285 |
| 36.25 | 16.1875 | 328.9133 | 333.6797 | 338.4462 | 343.2127 |
| 37 | 16.51563 | 322.0974 | 326.8639 | 331.6304 | 336.3969 |
| 38.5 | 17.17188 | 308.4658 | 313.2323 | 317.9988 | 322.7652 |
| 39.25 | 17.5 | 301.65 | 306.4165 | 311.1829 | 315.9494 |
| 40 | 17.82813 | 294.8342 | 299.6007 | 304.3671 | 309.1336 |
| 40.75 | 18.15625 | 288.0184 | 292.7849 | 297.5513 | 302.3178 |
| 41.5 | 18.48438 | 281.2026 | 285.969 | 290.7355 | 295.502 |
| 42.25 | 18.8125 | 274.3867 | 279.1532 | 283.9197 | 288.6862 |

| | | TITANIUM WOOD SHAFT | | | |
|---|---|---|---|---|---|
| TIPPED | | 0 | 0.75 | 1.5 | 2.25 |
| EFFECTIVE LENGTH | MOMENT | | | | |
| 35.5 | 15.85938 | 335.7291 | 340.4955 | 345.262 | 350.0285 |
| 36.25 | 16.1875 | 328.9133 | 333.6797 | 338.4462 | 343.2127 |
| 37 | 16.51563 | 322.0974 | 326.8639 | 331.6304 | 336.3969 |
| 38.5 | 17.17188 | 308.4658 | 313.2323 | 317.9988 | 322.7652 |
| 39.25 | 17.5 | 301.65 | 306.4165 | 311.1829 | 315.9494 |
| 40 | 17.82813 | 294.8342 | 299.6007 | 304.3671 | 309.1336 |
| 40.75 | 18.15625 | 288.0184 | 292.7849 | 297.5513 | 302.3178 |
| 41.5 | 18.48438 | 281.2026 | 285.969 | 290.7355 | 295.502 |
| 42.25 | 18.8125 | 274.3867 | 279.1532 | 283.9197 | 288.6862 |

GOLF SWING ANALYSIS AND METHOD OF CUSTOM TRIMMING GOLF CLUB SHAFTS

This is a continuation-in-part of application Ser. No. 07/998,662, filed Dec. 30, 1992, now U.S. Pat. No. 5,351, 952.

TECHNICAL FIELD

This invention relates to the field of sports equipment, and more specifically to methods for custom trimming a golf club shaft to match the club's natural frequency of oscillation to a golfer's swing time.

BACKGROUND ART

In the sport of golf, it is desirable for a golfer's swing to be the same when using any golf club in the golfer's set of clubs. This consistency results in consistently straight and predictable distance drives. With a typical set of golf clubs a golfer is required to slightly adapt his swing according to different characteristics of each different club in order to obtain a straight and maximum distance drive with that club. It is desirable, however, that every golf club in a set have characteristics to allow a golfer to keep a consistent swing and obtain the optimum results with each club.

A golf club is effectively a cantilevered beam (a club shaft held rigidly at a hand gripped end) having a mass (a club head) mounted to one end opposite the hand gripped end. The golfer's swing begins with the take away during which the golfer raises the club from addressing the ball to a raised position. The club is then reversed and the club is swung downwardly. At the beginning of a golfer's downward swing, the grip end of the club is first moved by the golfer's hands and the club shaft flexes, momentarily leaving the massive head in place. The shaft flexes in reaction to the angular acceleration of the club head and any momentum from the take away. Golfers want the shaft to have straightened from the flexed position and be moving forward at the point in the swing at which the club head impacts the ball, in order to maximize the velocity of the club head. This maximum head velocity maximizes the energy transferred to the golf ball, contributed by the shaft assisting in driving it as far as possible with that club. Additionally, with the club shaft straight, the angled face of the club head is correctly oriented with respect to the shaft, giving the ball the specified loft for that club.

It is desirable that each of the different clubs in a golfer's set have characteristics that cause the club shafts to be straight at ball impact regardless of the club in the set being swung. By always getting a straight shaft at impact, regardless of the club, each club can be swung identically, giving optimum results and allowing the golfer to perfect his swing and obtain consistent results. The problem with making each golf club in a set have the desired characteristics is in determining the characteristics of each golf club that are to be as desired, understanding the important parts of each golfer's swing, and matching a golf club to a particular golfer's swing.

Numerous patents have been issued for means and methods for determining characteristics of golfers' swings. Hammond, in U.S. Pat. No. 3,945,646, teaches to mount accelerometers at various locations in a golf club. The accelerometers are electrically connected to a data processor which calculates certain position related characteristics of the golf club during a golfer's swing. This invention uses the accelerometers for analyzing the swing of a particular golfer to correct the swing, not for determining characteristics of a golfer and then matching those characteristics to golf clubs.

In U.S. Pat. No. 4,615,526, Yasuda et al. mount magnets and sensors to a golf club and a platform. The apparatus is used during the swing of the club to determine the velocity of the club head and angle of approach at, and near, ball impact. These characteristics of the golfer's swing are also used to analyze a golf swing for the purpose of correction, not to match a golfer to a golf club.

Additional U.S. Pat. Nos. 4,630,829, 4,878,672, 4,967, 596, and 4,991,850 teach the use of electrical and mechanical devices for measuring velocity, centrifugal force during club swing, and impact energy of a ball with a club head. Most of these inventions are used to determine characteristics about a golfer's swing in order to correct or change the golfer's swing. None of the prior art inventions use characteristics of a golfer's swing to determine the flexibility a golf club shaft should have for that golfer.

It is known to take a plurality of golf clubs that have different natural frequencies of oscillation and, by trial and error, find the natural frequency of a golf club that best matches a particular golfer. This is done by the golfer taking numerous swings with each golf club, and choosing the one which gives the golfer the best respective results, such as drive distance and straightness of drive.

It is also known to make a chart which tells how much of a golf club shaft to remove from each end of the shaft in order to arrive at the desired natural frequency. In U.S. Pat. No. 4,122,593, Braly discloses a chart which is used to find a desired natural frequency and length in order to determine how much to remove from each end of a golf club shaft.

Additionally, in U.S. Pat. No. 4,555,112, Masghati discloses a golf club shaft having tip and grip ends which always remain the same length, but which have a connecting, central portion having length and wall thickness which can be varied.

The need exists for a method for measuring specific characteristics of a golfer's swing, and matching a golf club or a set of golf clubs to those characteristics. This matching method should include the determination of how much of a shaft should be removed.

BRIEF DISCLOSURE OF INVENTION

The invention is a method for custom trimming a golf club shaft. The shaft is trimmed at locations which form the shaft with both a length appropriate for an individual golfer's club based upon the golfer's size and a natural frequency of oscillation, $f_g$, which has been predetermined as appropriate for that golfer's club based upon the golfer's swing characteristics. The natural frequency of oscillation, $f_g$, is in a cantilevered beam mode of oscillation in which a narrow end of the shaft oscillates along an arcuate path about a grip end of the shaft.

The method comprises measuring the natural frequency of oscillation, $f_c$, of a shaft which is a replica of and therefore is representative of a specified type of shaft. The natural frequency is measured at a plurality of different effective shaft lengths for the replica shaft, and at a plurality of different tipping amounts for each effective shaft length. Measurements are taken over a range of effective shaft lengths and a range of tipping amounts. The moment, $m_c$, of the replica shaft is calculated for each of the plurality of different effective shaft lengths.

The method further comprises performing a linear regression on the measured frequencies to obtain the coefficients A and B for an equation which algebraically approximates the measured natural frequency data in the form $f_c$=C+A*tipping amount+B*$m_c$. The method further comprises selecting a shaft from inventory which has been measured to determine its natural frequency of oscillation, $f_c$, at a selected moment, $m_c$, and then calculating the constant, C, for the inventory shaft wherein C=$f_c$–B*$m_c$. The moment, $m_c$, is simply the shaft length from the center of the club head to the most distal, gripped portion multiplied by the club head weight.

The next step in the method is the calculation of the appropriate tipping amount for the inventory shaft wherein tipping amount=($f_g$–C–B*$m_g$)÷A where $m_g$ is the desired moment of the golfer's finished golf club. Once the tipping amount is calculated, a length of the narrow end of the inventory shaft equal to the tipping amount is removed, and a length of the grip end of the inventory shaft equal to an initial shaft length minus both the tipping amount and the desired final shaft length is removed. This leaves the shaft with the length appropriate for the golfer as measured by a golf pro or other golf club sales agent.

Performing a linear regression in the preferred embodiment includes calculating the quotient, A of (i) the difference between the measured frequencies for a pair of different tipping amounts at the same effective replica shaft length, and (ii) the difference between the same pair of tipping amounts. Performing the linear regression also includes calculating the quotient, B of (i) the difference between a pair of measured frequencies for a selected tipping amount and (ii) the difference between two moments for the effective replica shaft lengths at the same pair of measured frequencies.

The invention contemplates a situation in which the constants A, B and C are predetermined and therefore already known for each type of shaft and each particular shaft. In this situation, the tipping amount would merely be calculated given the constants A, B and C with the equation listed above for tipping amount.

Further contemplated by the invention is a method in which the tipping amount necessary to form a shaft having the desired natural frequency is estimated, a length of the narrow end of the shaft equal to the estimated tipping amount is removed, and the natural frequency of oscillation of the shaft is measured. Once the natural frequency of the oscillation of the shaft is measured, if this frequency is less than the desired natural frequency, the above steps of estimating a tipping amount, removing that tipping amount from the narrow end of the shaft and measuring the natural frequency are repeated until the measured natural frequency is equal to, or closely approximates, the desired natural frequency. A length of the grip end of the shaft is subsequently removed which is equal to the initial shaft length minus both the total tipping amount and the desired final shaft length.

TABLE 1

Explanations of some variables and constants:

$f_g$ is the natural frequency of a golfer's unique swing based on swing time. The subscript g denotes golfer.

$m_g$ is the desired moment of a club that is to be built for a golfer. Subscript g denotes the golfer.

$f_c$ is the natural frequency, as measured, for a particular golf club or shaft. Subscript c denotes club.

$m_c$ is the moment calculated for a particular club or shaft under certain conditions (club head weight, effective length). Subscript c denotes club.

A is a coefficient found in Equation 3 and represents the vertical spacing between each curve on the graph of FIG. 9.

B is a coefficient found in Equations 3 and 4 and represents the slope of the curves in FIG. 9.

is a coefficient found in Equations 3 and 5 and represents the difference between the representative replica shaft and the inventory shaft.

Figure 1:
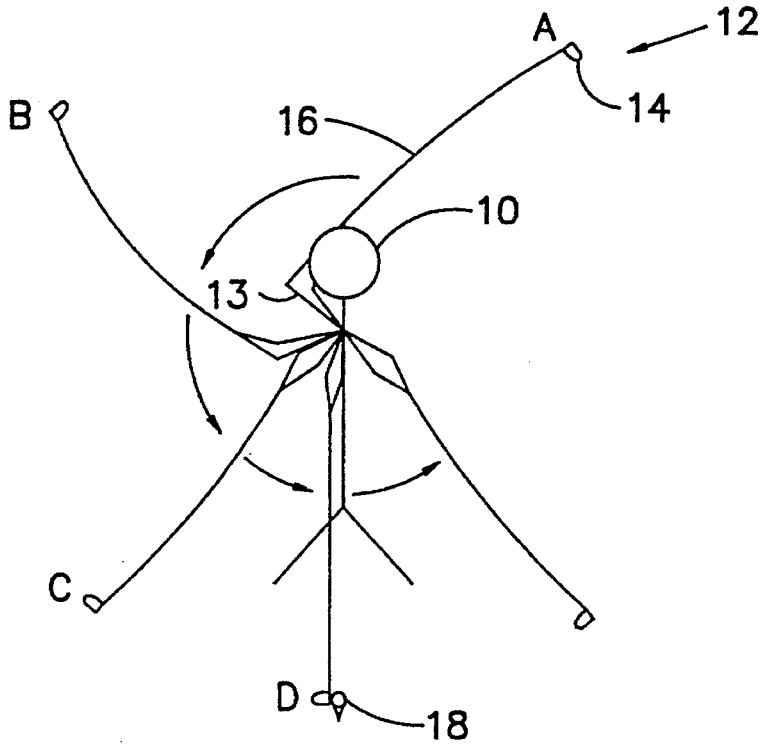
FIG. 1 is a schematic view illustrating a golfer in progression through a golf swing.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

In the original patent application, the following was described.

A golfer 10 is illustrated in FIG. 1 swinging a golf club 12 through multiple positions of a typical golf swing. With the club head at rest at position A, the golfer 10 begins his golf swing, accelerating the golf club 12 by applying a force to a grip end 13 of the club 12. The golf swing begins when a club head 14 intimates a downward acceleration. This is either when the golf club 12 is at rest and a downward force is applied to begin the swing downward, or when the golf club 12, having an upward velocity due to backswing, is suddenly stopped and reversed in direction by a downward force, initiating downswing. When the grip end of the club is accelerated, the club shaft begins to be deflected and begins to apply a force to the club head. That force is a spring force equalling the product of the amount of deflection multiplied by the spring constant. The spring force begins accelerating the club head in accordance with Newton's law F=ma. As club shaft deflection is increased by the force applied to the grip by the golfer, resulting in acceleration of the grip, the acceleration increases until maximum deflection is reached at point B.

Therefore, when the club head 14 reaches position B, it has an increased velocity, and maximum potential energy stored in the deflected club shaft and available to accelerate the club head 14 to a higher total velocity at impact. The club head 14 has maximum potential energy because the flexible golf club shaft 16 has deflected a maximum amount from its initially straight, undeflected shape. Acceleration decreases during the swing after the maximum at position B while club head velocity continues to increase. When the golf club 12 reaches position C, the velocity of the club head 14 is increased still further and the acceleration is decreased from its positive maximum at position B, with the shaft 16 somewhat straighter. At position B, where shaft deflection is maximum, club head velocity is the velocity of the radially oriented club shaft axis extending through the club grip. After position B, club head velocity is the sum of the velocity of the radially oriented axis of the club shaft extending through the club grip and the velocity of the club head relative to that axis resulting from the potential energy of the deflective club shaft being used to move the club head forward with respect to that axis.

When the golf club 12 reaches position D, an infinitesimal instant before impact with a ball 18, the club head 14 preferably has maximum velocity, and the angular acceleration of the club head 14 is approximately zero. At the instant of impact with the ball 18, the acceleration of the club head 14 becomes negative (deceleration) and its velocity decreases quickly, due to the significant energy transfer from the club head 14 to the ball 18. The shaft 16 is preferably straight when the club head 14 impacts the ball 18. After the ball 18 has been hit and is driven away from the club head 14, the club head 14 acceleration changes positively, increasing towards zero from its negative value.

Figure 5:
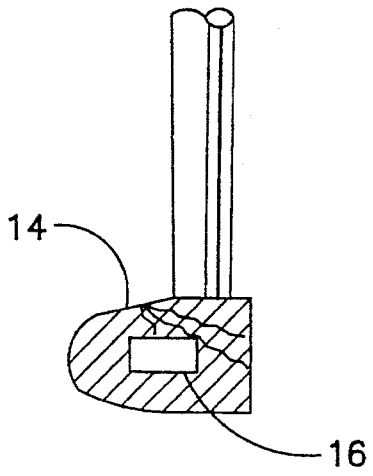
FIG. 5 is a side view in section illustrating a preferred embodiment of the present invention.
Figure 6:
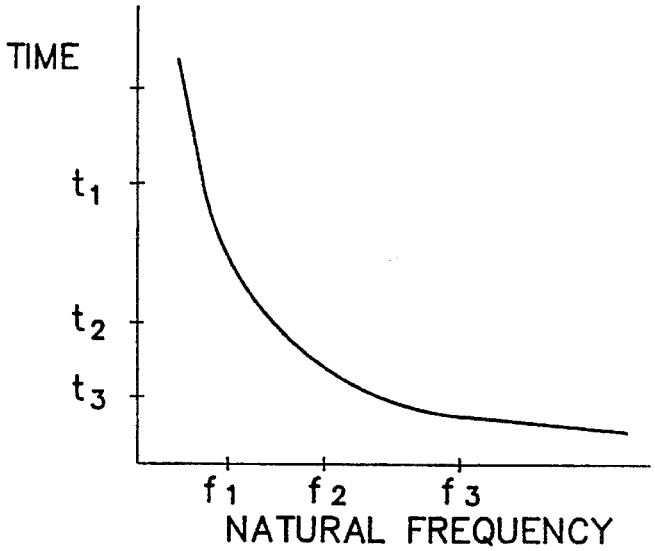
FIG. 6 shows a plot of swing time (t) versus natural frequency of vibration (f) for three examples, without using specific values.

In the preferred embodiment of the present invention an accelerometer 19 is mounted in the club head 14, as shown in FIG. 5 in detail, to measure the above described changes in acceleration, with respect to time, that the club head 14 undergoes. By connecting the accelerometer 19 to an electronic data processor (not shown), it is possible to plot a graph of acceleration versus time according to the data received from the accelerometer 19. The acceleration measured can be radial acceleration, angular acceleration, tangential acceleration or resultant acceleration. Preferably, the accelerometer 19 measures radial acceleration which is directly proportional to angular velocity.

Figure 2:
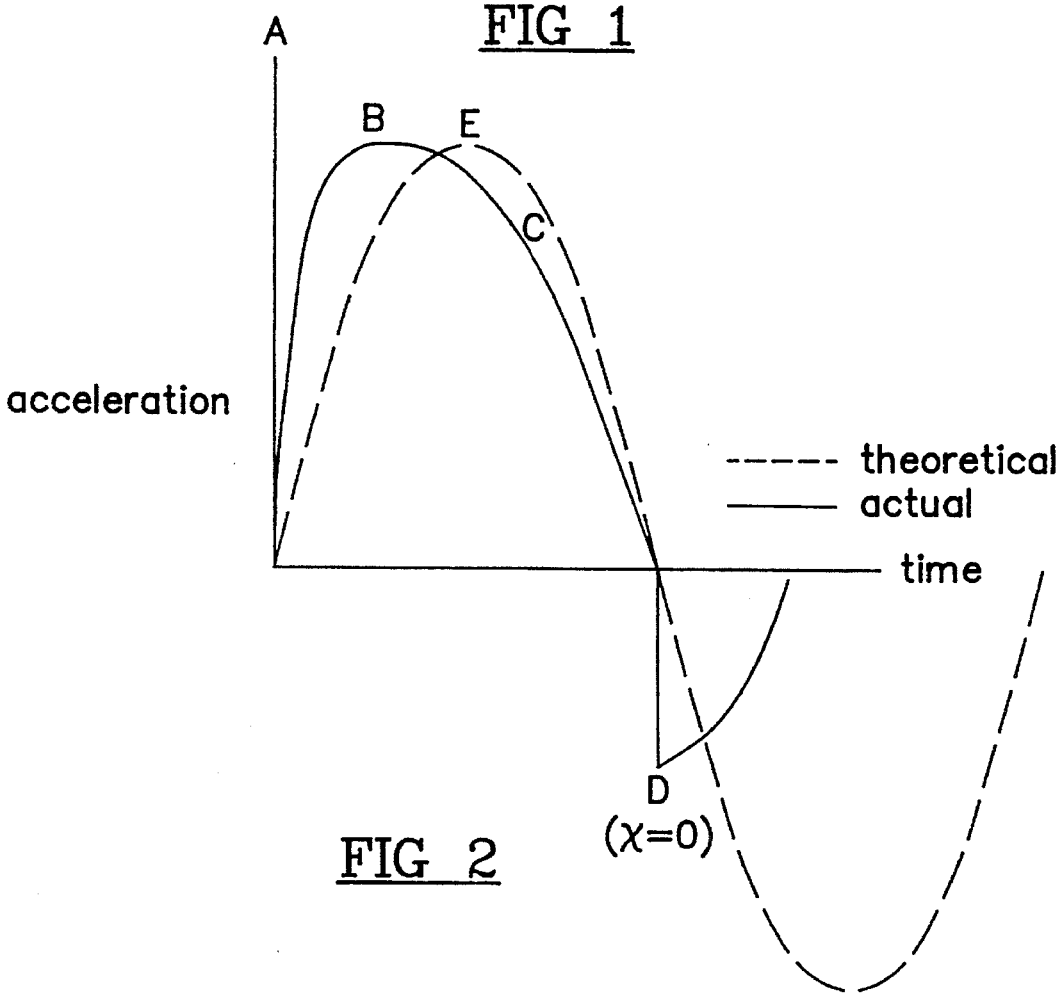
FIG. 2 is a graph illustrating angular acceleration versus time.
Figure 10:
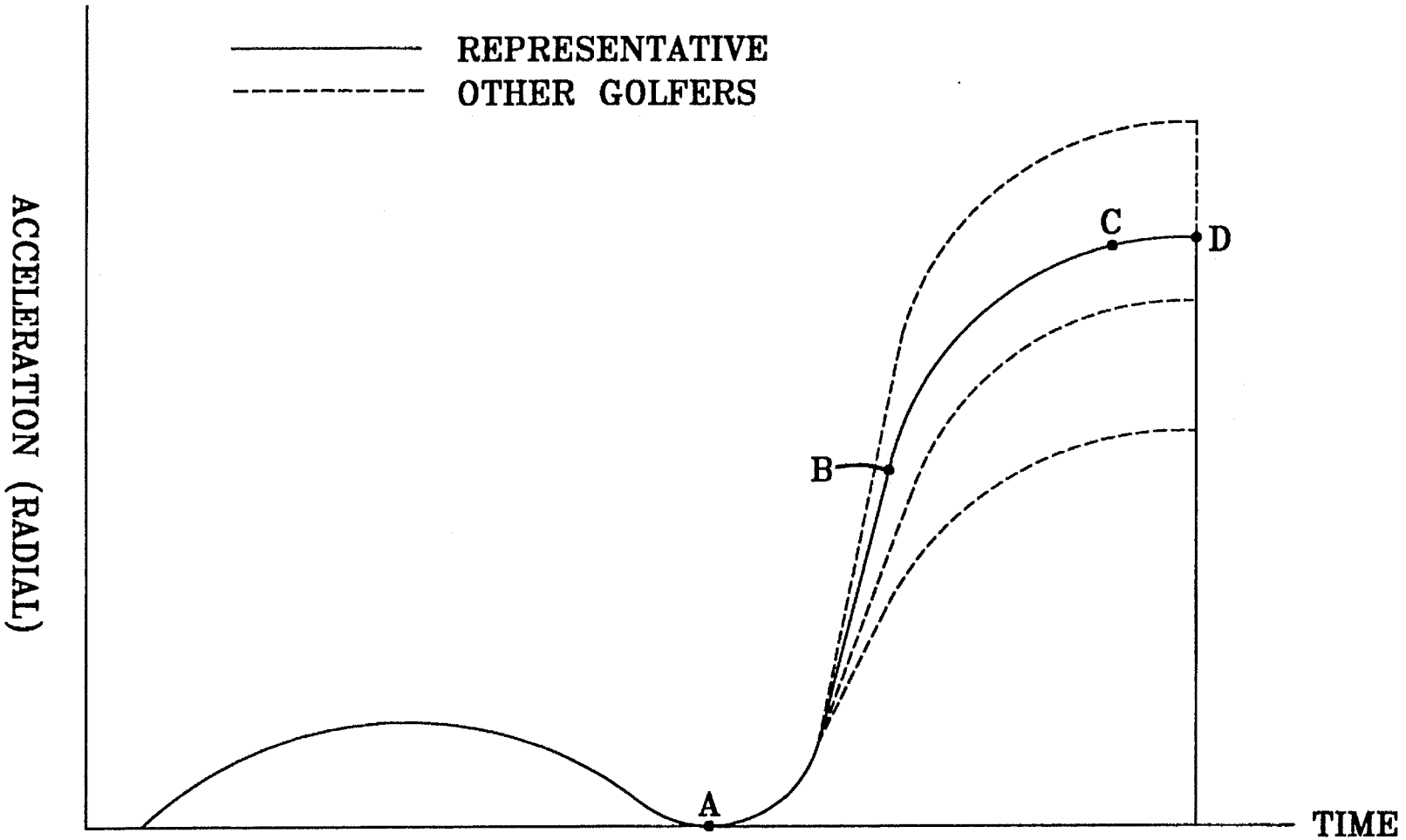
FIG. 10 is a graph illustrating radial acceleration versus time.

A graph of angular acceleration (which is the first derivative of angular velocity and therefore is directly proportional to the first derivative of radial acceleration) versus time is illustrated in FIG. 2, and a graph of radial acceleration (which is proportional to angular velocity) is plotted against time in FIG. 10. The positions A, B, C and D on the graphs of FIGS. 2 and 10 correspond with the positions A, B, C and D of the golf swing illustrated in FIG. 1. Although the graph of FIG. 2 is used to describe the principles of the present invention, preferably radial rather than angular acceleration is measured since it gives a greater variation of data points, which makes finding a characteristic data point easier. Swing time is measured as the time elapsed between points B and D. These points represent the latest point of maximum slope and ball impact, respectively. In all cases, swing time is the time elapsed from the time of maximum club shaft deflection until the time of ball impact. There are many ways to measure this swing time.

The graph of FIG. 2 shows both a theoretical curve and an actual curve. The actual curve is the curve obtained with the preferred embodiment when an accelerometer 19 is mounted in a golf club head and a golfer performs his typical golf swing. The theoretical curve represents perfectly (ideal) periodic motion of a golf club mounted in a device which permits vibration of the club in a cantilevered beam mode of oscillation for purposes of explanation. The actual curve differs from the theoretical curve since there is both a transient force applied by a golfer at initiation of the golfer's swing and a non-sinusoidal force applied by the golfer during the swing which are characteristic of the nonperiodicity inherent in human motion.

Although the actual curve generated by a human golfer differs from the theoretical curve obtained, it is possible to use the theoretical curve and the principles accompanying periodic motion to approximate the actual curve. The approximation is accurate enough that the swing time of a golfer can be used to determine, with substantial accuracy, the natural frequency of a golf club which will match the golfer's swing time.

In determining the swing time of a golfer, the time elapsed between position B (the maximum angular acceleration) and position D (the drop in acceleration characteristic of impact with the ball) on the actual curve of FIG. 2 is measured. This time value is one-fourth of the period of a theoretical curve which the actual curve approximates. Since the period is the inverse of the natural frequency ($f_g$), the ideal and preferred measured swing time is $$\text{swing time} = \frac{1}{4f_g}\ . \qquad \text{(Equation 1)}$$

Since the motion of a golfer initiating downswing is a transient, non-sinusoidal motion, it introduces start-up error, or discrepancies relative to ideal periodic motion. A golfer does not apply a periodic, sinusoidal driving force to the club grip which is typical of the periodic motion of a driven resonant body usually studied in the dynamic motion of bodies. Instead, the golfer applies an accelerating force at the beginning of the swing which increases up to the point B, and then decreases as the swing progresses beyond point B. Between points B and D this force is not 0 and is not a sinusoidal driving force. Accordingly, the peak of the actual acceleration is shifted from its theoretical time closer to the beginning of the swing. Therefore, an adjustment factor, k must be used to calculate the golfer's swing time to get the actual curve (non-sinusoidally driven club) to more closely approximate the theoretical curve (sinusoidally driven club). Equation 1 is, therefore, only approximate for a golfer's swing, and requires an adjustment factor k, giving $$\text{Swing time} = \frac{k}{4f_g}\ . \qquad \text{(Equation 2)}$$

The object of the present invention is to measure the swing time of a golfer's swing and calculate a natural frequency, $f_g$, of a golf club that will result in maximum net club head velocity for that golfer at the time of ball impact. A golf club having a measured natural frequency, $f_c$, matching the calculated natural frequency, $f_g$, calculated from Equation 2 will match the golfer's swing time.

For measuring the natural frequency of the club, it is well known to rigidly mount a conventional golf club by its grip in a clamping machine, displace the club head and release it, causing the club to oscillate about the grip end along an arcuate path. This cantilevered beam mode of oscillation is illustrated by the theoretical curve of FIG. 2. It is also known that the frequency of oscillation of that golf club is its natural frequency, $f_c$. By varying both the length of the club shaft, the stiffness and other physical properties of the club shaft, and the mass of the club head, the natural frequency of the golf club can be varied.

Figure 3:
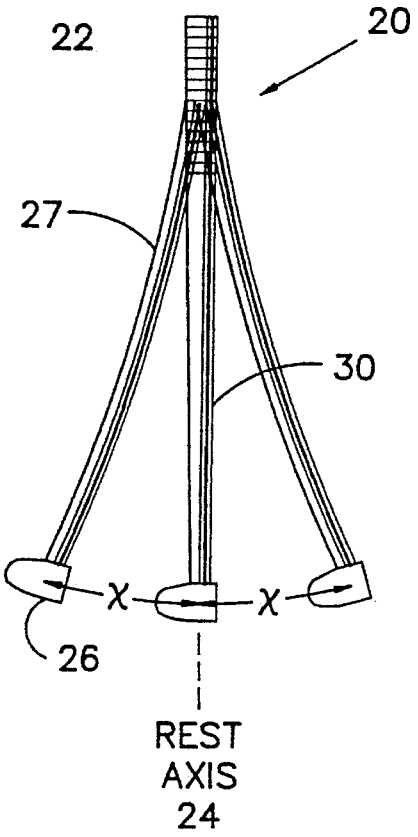
FIG. 3 is a side view illustrating deflection positions of a golf club.

An illustration of a golf club 20 oscillating about a grip end 22 is shown in FIG. 3. The golf club 20 is shown as it deflects when it is swung through a typical golf swing or, similarly, as it is oscillated when held in a clamping machine, displaced and released. An imaginary rest axis 24 (the previously mentioned axis through the grip), extends from the grip end 22 and passes linearly through the undeflected golf club shaft 30, shown in the center of the illustration of FIG. 3. During deflection of the golf club 20 in either direction from the rest axis 24, the club head 26 is displaced a distance X from the rest axis 24, shown in FIG. 3.

The time changing angular acceleration of the machine mounted golf club 20 is illustrated by the theoretical curve shown in FIG. 2. When the oscillating golf club 20, held at its grip 22 end, passes through the rest axis 24 (at x=0), the angular acceleration of the club head 26 is zero and its velocity is maximum. It is as the club head 26 passes through the rest axis 24 that the velocity of the club head 26 with respect to the rest axis 24 is maximum, and therefore where it is desirable that the club head 26 strike a golf ball when the club 20 is swung by a golfer.

The reason why a golfer wants maximum club head 26 velocity with respect to the rest axis 24 at ball impact is that the golf club 20 has two velocity components when swung by a golfer. The first velocity component is the velocity of the club head 26 with respect to the rest axis 24 as described above. Secondly, there is the angular velocity of the moving rest axis 24 which is a function of the angular velocity of the golfer's hands at the grip 22 end. The net velocity is the sum of these two velocities. It is most desirable to maximize the velocity of the club head 26 with respect to the rest axis 24 at ball impact to maximize the net velocity of the club head 26 upon impact. This will impart maximum momentum to the golf ball, and will drive the golf ball the greatest distance for the particular golf club.

There is a difference between the way the force is applied by a person swinging a golf club holding it at the grip end, and the way the force is applied when the golf club is in a clamping device measuring the natural frequency. An adjustment factor, as described above, will be necessary for correcting this discrepancy between perfect periodic motion and actual motion of golfer's swings.

The theoretical, periodic motion of the oscillating golf club of FIG. 3, shown graphically in FIG. 2, is what the present invention is assuming a golfer's swing approximates. As a golfer progresses through his swing, the angular acceleration reaches a peak value and then decreases to zero over time and takes a characteristic negative plunge at ball impact. If the time between peak acceleration and ball impact is measured (with an accelerometer) and is equated to the inverse of four times the natural frequency of a golf club (as measured in a clamping machine), the golfer using that golf club should have a straight club shaft, and have maximum net velocity of the club head at ball impact once the adjustment factor has been included to make the approximation more accurate.

As the club head decreases in acceleration from its actual peak acceleration, the assumption is made that the actual decrease in club head acceleration from peak to zero occurs more quickly than it actually does, similar to the theoretical curve, allowing the club head to move as a freely oscillating body back toward its rest axis like the club 20 clamped in a device shown in FIG. 3. This approximation assumes either a complete lack of force applied by the golfer on the rest axis (the grip) after the peak angular acceleration is reached at point B, or the application of a sinusoidal drive with a slight phase lead. This assumed lack of an external force or sinusoidal drive allows the deflected shaft of the club to begin to straighten like a freely oscillating body with the rest axis having constant velocity and zero acceleration.

In the case of a golf club which is held in a clamp, bent and released to oscillate, the rest axis has no acceleration, allowing for the analogy to be drawn between a golf club being swung (an actual external force applied to the club after peak acceleration) and a club mounted in a clamp (no external force applied to rest axis after peak acceleration). The approximation which permits measuring the time between maximum angular acceleration (analogous to release of the bent, clamped club) and ball impact (at x=0 for clamped club) and equating that to the inverse of four times the natural frequency departs from the theoretical situation only to the degree that the external force applied to the rest axis for a golfer swinging does not actually decrease as rapidly to zero as the theoretical after maximum angular acceleration. A non-sinusoidal and/or non-in-phase force is actually applied by a human golfer to the rest axis between maximum angular acceleration and ball impact which shows the decrease to zero. The adjustment factor, k makes up for the fact that the actual departs from the theoretical, and allows the theoretical principles to be applied to the actual situation.

By assuming that once the club head reaches maximum angular acceleration in a golfer's swing, the club approximates a club mounted in a frequency measuring machine, the matching of a golfer's swing time to a particular golf club's natural frequency is mathematically accomplished with Equation 2.

Therefore, what is effectively being measured is the actual amount of time it takes a deflected golf club shaft to straighten itself: whether released while held in a clamp and deflected, or released from deflection in a golfer's unique swing. This equation is then used to match the unique swing time to a particular golf club (having a known natural frequency $f_c$).

The time in both cases is approximately equal to one-fourth the inverse of the natural frequency, herein called the swing time. The swing time is the amount of time it takes in a golfer's swing for the golf club to impact the ball from maximum club shaft deflection. With a good approximation of swing time, a golf club can be selected which will straighten itself by the time ball impact occurs to give the club head the maximum net velocity for the particular golfer.

The preferred golf club, effectively a cantilevered beam, deflects a distance X under acceleration applied by a golfer swinging the club. The distance X the golf club head is deflected is proportional to the amount of angular acceleration of the golf club caused by the golfer. The equation $$F=ma$$

where:

m is the mass of the golf club (primarily head); and a is the acceleration of the golf club rest axis shows that a force F applied to the golf club grip results in a proportional acceleration in the golf club. The equation $$F=xk_s$$

where:

x is the displacement of the club head from the rest axis; and $k_s$ is the spring constant of the club shaft shows that a force F applied to a golf club grip by a golfer results in a deflection of the club shaft, proportional to the force applied. By equating the above equations, the resultant is $$ma=xk_s$$

This equation shows that an acceleration of the golf club axis results in a proportional deflection of the club shaft, displacing the club head a distance x from the rest axis, proportional to the acceleration applied. The preceding equations illustrate the effect that angular acceleration has on deflection of the golf club shaft, and the displacement x of the club head from the rest axis. Of course, a finite time must be allowed for an acceleration to result in a given deflection due to the impossibility of instantly displacing a mass (club head).

The present invention involves first locating both the peak angular acceleration and the ball impact in a golfer's swing and then determining the time between them (the swing time). From that time interval, the desired natural frequency for a club is determined. A golf club is then selected from inventory of pre-manufactured clubs, or a club is custom made from components to have that natural frequency that will cause it to complete the displacement from deflected to straight in the amount of time it takes the golfer to swing from maximum acceleration to ball impact.

As mentioned above, the fact that the actual, measured acceleration curve is an approximation of the theoretical acceleration curve requires that the adjustment factor, k be obtained in order to more accurately determine the natural frequency necessary for a particular golfer. The adjustment factor, k is determined in the preferred embodiment by a plurality of steps as follows.

First, the time or position in a swing at which peak angular acceleration is reached and the characteristics of each person's swing after peak acceleration vary among golfers. FIG. 10 illustrates the swings of many golfers plotted with radial acceleration versus time. Because of these differences, a swing representing many golfers' swings is measured. The first step in calculating the adjustment factor k is measuring the radial acceleration with respect to time and obtaining the swing time of a golfer who has a swing representative of most golfers. By representative, it is meant that the golf swing of this representative golfer should have characteristics which accurately represent the golf swings of most golfers. This means the representative's swing should have a swing time intermediate of the times that most golfers have, or their representative may be a composite or average of a sizable sampling of golfers. In the preferred embodiment this representative is a professional golfer, although it could also be a multiply adjustable machine that swings a golf club or any other suitable representative.

The second step in determining the adjustment factor k after obtaining a representative swing time is finding the natural frequency of a golf club which gives that representative golfer maximum club head velocity at ball impact. This is a trial and error process in which the representative golfer swings a plurality of golf clubs, each at a different natural frequency. This process should result in the selection of a particular golf club of a predetermined or subsequently measured natural frequency, the club being selected from the plurality of golf clubs which are swung through the representative golf swing. The club head velocity of each of the plurality of golf clubs swung is measured as the clubs are swung through the representative golfer's consistent swing.

In the preferred embodiment a professional golfer, who has the representative golf swing, swings a plurality of golf clubs, and the velocity of the club head (at ball impact when swung in the representative golf swing) is measured. The golf club giving the greatest club head velocity at ball impact is the particular golf club which is selected. Once a particular golf club is selected as the club giving the greatest club head velocity at ball impact for the representative golfer, the natural frequency, $f_c$, of that golf club is noted and used below for calculating k. A less scientifically accurate, yet related characteristic of the representative golfer's swing may be measured, such as the distance golf balls are driven with each of the plurality of clubs. The important factor to be considered is the club's kinetic energy at ball impact, which determines the amount of energy that can be imparted to a contacted ball. Velocity and ball distance are increasing functions of club head energy. There are many other measurable or calculable parameters which relate to kinetic energy. The representative golfer swings each of the plurality of golf clubs with his consistent swing to determine which club is most suited to the representative golfer.

The next step in calculating the adjustment factor k involves solving Equation 2 for k using the representative's swing time and the natural frequency obtained in the step of finding the golf club giving the representative the greatest club head velocity at impact. The equation k=swing time*4*$f_c$ is obtained. Because the representative golfer's golf swing accurately represents the golf swings of most golfers, the adjustment factor k obtained for that swing time can then be used to adjust the measured swing times for other golfers to obtain a natural frequency which accurately represents the swing time of the other golfers.

The Applicant has calculated the adjustment factor k using a professional golfer as the representative and has determined k to be substantially 1.6 for this representative. The value of k can vary widely based upon the selection of the representative. The Applicant has made limited experimentation in determining k. Based upon these experiments, k has been determined to be substantially 1.6. However, using the invention, a substantially different value for k could foreseeably be obtained based upon the Applicant's recognition of the wide variation in the swing characteristics of all potential representatives. If a k different from 1.6 is obtained, it would still work in the present invention. Using a different golfer, or a multiply adjustable golf swinging machine such as is marketed under the name "IRON BYRON", a different adjustment factor k may very foreseeably be obtained.

Figure 11:
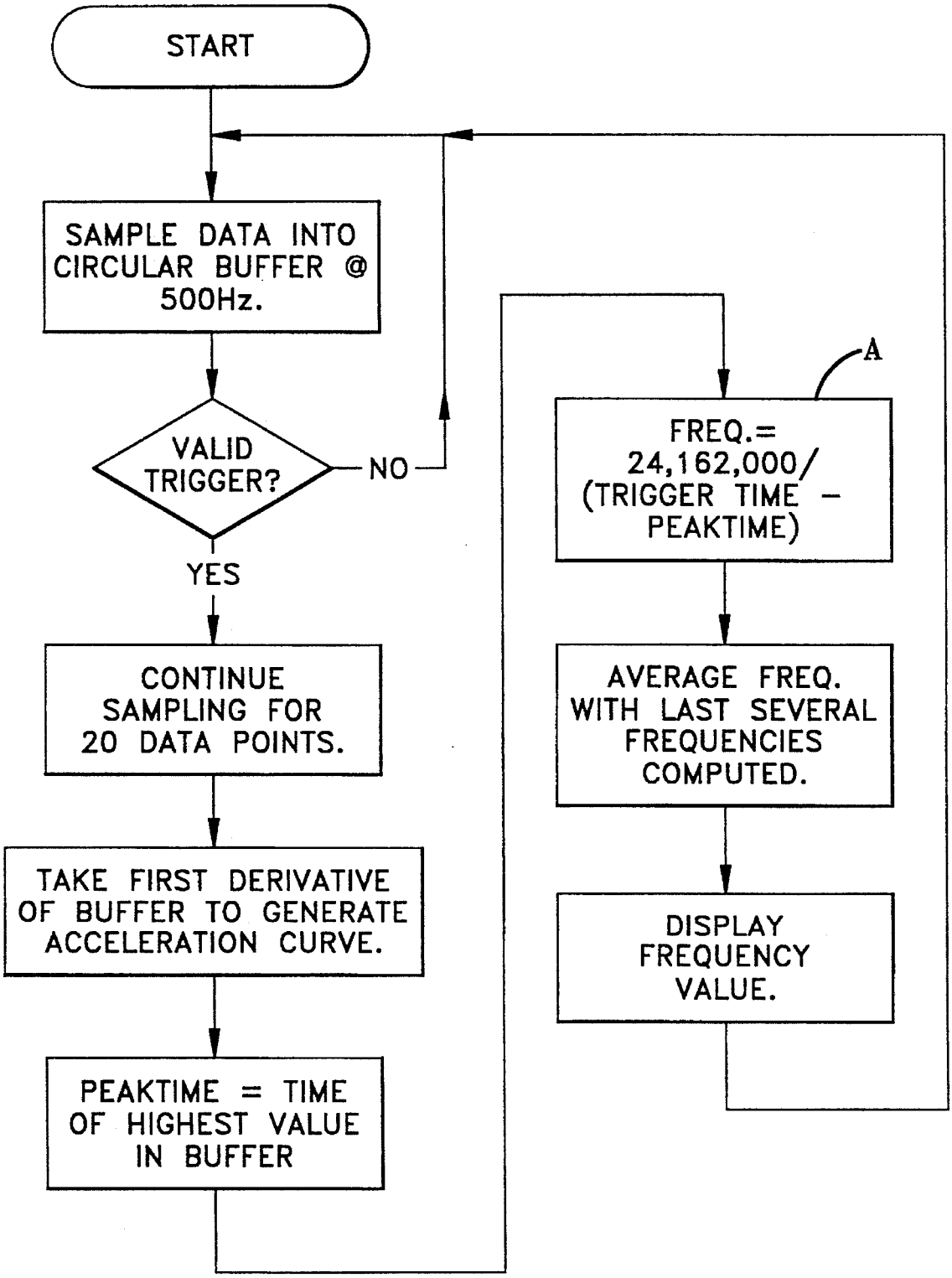
FIG. 11 is a flow chart.

FIG. 11 illustrates a flow chart used in the preferred embodiment of the present invention for calculating and displaying a frequency value from data received from an accelerometer. The 24,162,000 shown in Box A contains the adjustment factor combined with the internal timing of the computer processor and other numbers. 24,162,000 is equal to ¼ times k (1.608) times 60 million microseconds per minute. In Box A, "trigger time minus peak time" represents the swing time of the golfer.

If the golfer 10 in FIG. 1 swings the golf club 12 upwardly and does not consciously or knowingly stop the club 12 to allow the golf club shaft 16 to come to rest before initiating downswing, the present method of measuring swing time still works. By whipping the club 12 up in the upswing and then suddenly swinging it downwardly, the club head none the less instantaneously comes to rest. The deflection of the shaft 16 will be increased over starting the swing from a conscious rest, increasing velocity at the impact with the ball 18 if the golf club 12 is correctly chosen. The accelerometer method measures swing time as beginning at maximum downward acceleration. When the golf club 12 is swung upwardly and suddenly stopped and swung downwardly, the first application of force to the golf club 12 by the golfer 10 in the downward direction and will cause a downward acceleration to be sensed by the accelerometer. When this downward acceleration reaches a maximum, time will begin to be measured and will stop at ball impact. This is the same method used when the club 12 is allowed to come to rest prior to downswing initiation.

The accelerometer used in the present invention is of the type conventionally used, having small size and weight, capable of being mounted within a golf club head.

Figure 4:
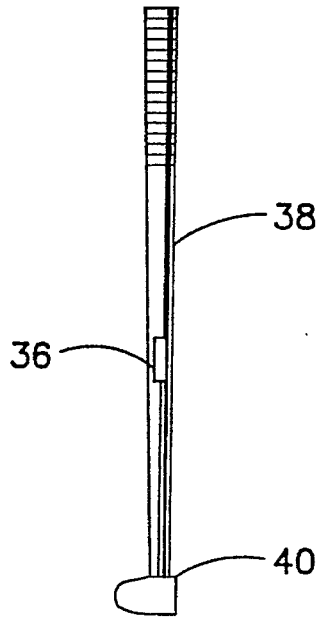
FIG. 4 is a side view illustrating an alternative embodiment to the present invention.

It is possible, as shown in FIG. 4, to install a strain gauge 36 on a golf club shaft 38 to sense deflection or stress of the golf club shaft 38 during the swing of a golfer. The strain gauge 36 would be connected to an electronic data processor which plots a graph of deflection versus time. The swing time is measured as beginning when deflection of the golf club shaft 38 begins to decrease after reaching a maximum, and ending at ball impact. To measure ball impact, a sensor, such as a piezoelectric crystal, can be installed in the face of the club head 40.

Although most people accelerate following the actual curve shown in FIG. 2, in which acceleration decreases after ball impact, an extremely strong person may continue accelerating after ball impact. For this person, the present method will still result in a golf club having a shaft which passes through the rest axis by measuring the swing time and equating it to the inverse of four times the natural frequency. Most people, however, have approximately zero acceleration at ball impact.

It is another object of the present invention to tune all of the golf clubs in a golfer's set to the natural frequency of the golfer's swing.

The swing time is defined above as the time between the maximum club head angular acceleration and ball impact (which gives a characteristic deceleration). Actual ball impact is not essential and can be determined by other means, such as by sensing club head position where impact would occur, for example by interrupting a light beam directed to a photo cell and passing through a location where the ball would be positioned. The acceleration curve can be narrower or broader than those shown in FIG. 2. The narrower curve will more quickly go from maximum to zero acceleration, more closely matching the assumptions made above, and vice versa for the broader curve. Additionally, the acceleration may reach a peak value and level off, dropping after some time, which will increase error, unless the time is measured from the time the acceleration begins to decrease, until ball impact. For most people the maximum acceleration coincides with the start of decreasing acceleration.

The graph of FIG. 2 is not necessarily representative of all golfers or even a lot of golfers, but is merely representative of one possible type of golf swing.

Now that the disclosure of the original application has been described above, the new disclosure, which is the subject of this continuation-in-part, follows.

Once the desired natural frequency, $f_g$ of the golfer's golf swing has been determined, it is desirable to make a golf club that matches the natural frequency of the golfer's swing. For a particular golfer, the final length of the finished golf club is usually known based on the golfer's height, and the type and the weight of the golf club head is also usually known based on the golfer's skill level. This shaft length may be determined by conventional, known prior art procedures. The remaining variable in making a golf club is the portion of a golf club shaft blank which will make a club constructed with that shaft have not only the appropriate length but also the desired natural frequency.

The present invention is directed to determining the amount of trimming of a standard sized shaft blank needed at both ends of the blank to make a club having both the desired length and desired natural frequency. Typically the shaft must be trimmed at one or both ends to give the desired final length. The amount removed from the ends of the shaft will affect the natural frequency of the finished golf club, since one end is narrower and therefore more flexible than the other. Trimming some of the shaft from, for example the narrow end, will make the finished club stiffer (resulting in higher natural frequency) than trimming the same amount from the larger grip end. The object of the invention, therefore, is to provide a method for determining the amount to be removed from each end of the shaft to arrive at a shaft of the appropriate length and natural frequency for a particular golfer.

There are many types of golf club shafts available to someone building golf clubs. Because of the enormous differences between these types of shafts, it is desirable to collect the shafts into categories with other shafts having the same characteristics. Some of the characteristics that shafts have which vary to distinguish shafts of a different type include the manufacturer of the shaft, the material such as preferred laminating, cross-sectional shape, longitudinal shape such as stepping or taper, club in the set for which the shaft is made [wood or iron], stiffness, etc.

Once the shafts are divided into categories differing by shaft type, a representative replica of each shaft type is tested to obtain characteristic data for that type of shaft. By testing a replica of each shaft type, the characteristics of that category of shafts can be known without having to test each and every shaft in that category that is in the club maker's inventory. The frequency of the representative replica shaft is measured on a device like a machine 50 shown in FIG. 7. The machine 50 clamps a representative replica shaft 52 between a pair of vice-like jaws 54 and 56 near a grip end 58 of the shaft 52. A weight 60 is attached to the shaft 52 near a narrow, tip end 62 and represents the mass of the club head.

The tip end 62 is displaced and released, causing the shaft 52 to vibrate with the tip end 62 following an arcuate path 64 about the grip end 58. The shaft 52 has an effective length which extends from the center of the weight 60 to the most distal clamped portion of the shaft 52. The calculation of effective length in the preferred embodiment is based on the size of the jaws 54 and 56 causing the clamped portion of the shaft 52 to be approximately equal to the length of the shaft 52 which will be held in the hands of the golfer in the conventional manner. The length of the jaws 54 and 56 is chosen to make the testing of the natural frequency of the shaft 54 simulate the shaft being held by a person's hands, making calculation of the amount removed from the grip end of the shaft 52 simpler. It is not necessary that the jaws 54 and 56 be this length, since substantially longer or shorter jaws can effectively grip the shaft 52 and allow it to be displaced and released to oscillate. If jaws of substantially different length are used, the effective length will then be equal to the distance from the center of the weight 60 to the most proximal clamped portion of the shaft 52, plus the length that a person's hands usually hold when a club is held in the conventional manner.

The effective length of the shaft in the preferred embodiment is changed by moving the shaft 52 in the jaws 54 and 56 and/or by moving the weight 60 along the shaft 52. The weight 60 is moved away from the narrow end 62 to provide various tipping amounts which correspond to the amount which is removed from the tip end 62 in order to construct a golf club. The tipping amount is the distance from the tip end 62 to the weight 60.

The replica shaft 52 is displaced and released to vibrate at a measured frequency for various effective lengths and tipping amounts. A range of tipping amounts is tested for each effective length. Preferably the tipping amounts vary from zero to 2.25 inches in increments of 0.75 inches. The effective length is also varied, preferably by 0.75 inches. The variation in the effective length from the longest to the shortest effective shaft length differs depending upon the initial length of the shaft 52. A typical variation in effective length is approximately 7 inches from the longest to the shortest effective length for an initially 40 inch long shaft. The natural frequency, $f_c$, is measured for each effective length and for each of a plurality of tipping amounts at each effective length. These data are then recorded and are used as discussed below.

The moment, $m_c$, of the shaft 52 is next calculated for each effective length. The moment is calculated by multiplying the effective length by the weight of the weight 60.

Figures 7, 8:
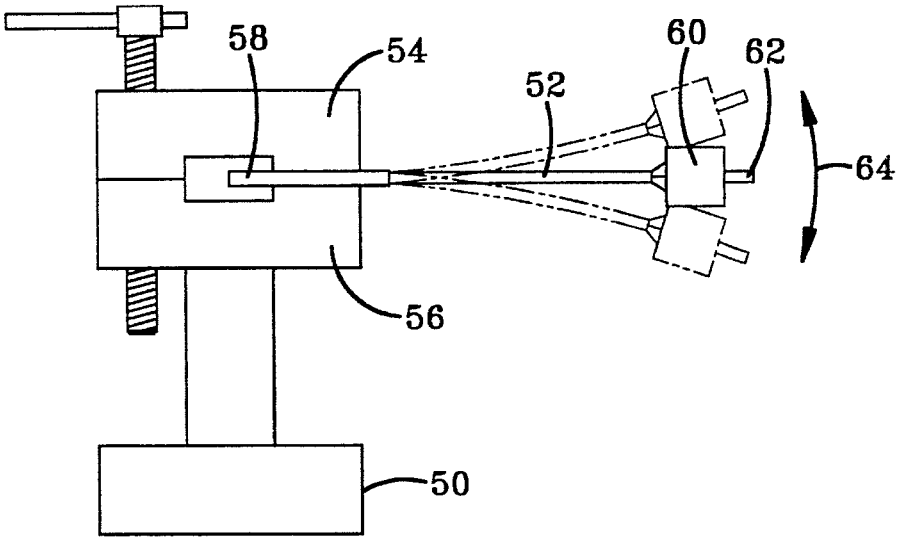
FIG. 7 is a side view illustrating a machine for clamping a golf club shaft.
FIG. 8 is a table containing illustrative data for a particular type of shaft.

A table may be constructed containing the data obtained by the above described method. An example of such a table is illustrated in FIG. 8. This table shows the data obtained for a replica which is representative of a particular type of shaft. It is not necessary to tabulate these data, because they can be stored in a computer or in some other data storage medium for later use without being placed in tabular form.

Figure 9:
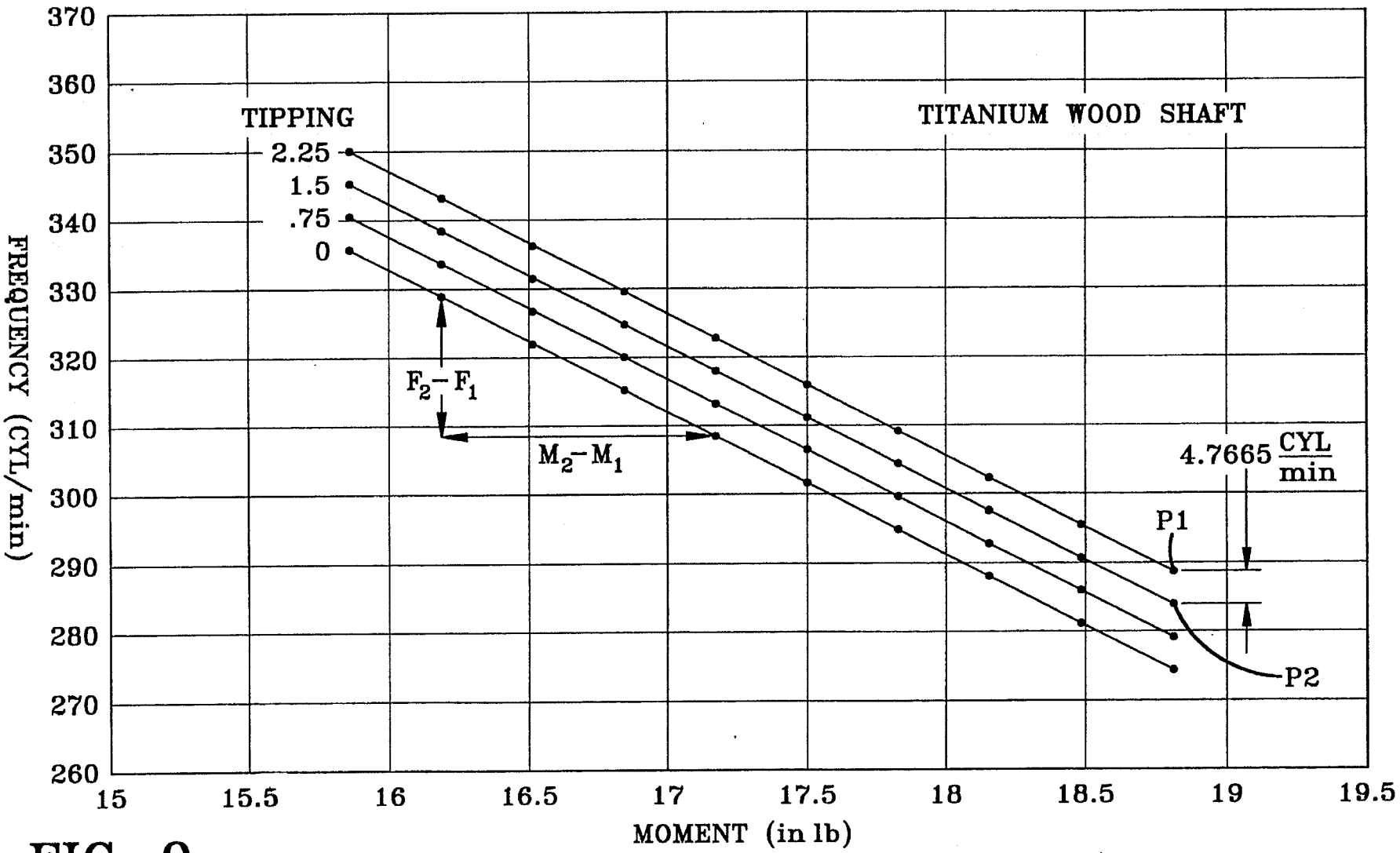
FIG. 9 is a graphical representation of the data shown in FIG. 8.

The data shown in the table of FIG. 8 may be graphically represented by the graph of frequency versus moment shown in FIG. 9. There is a plurality of curves in the graph of FIG. 9, each curve representing a specific tipping amount as indicated at the upper left end of each curve in FIG. 9. It is not necessary to represent the data obtained by the above method in graphical form, but to illustrate the whole method, it is helpful.

The next step in the method of custom trimming a golf club shaft is to perform a linear regression on the data obtained and shown in FIG. 8. The linear regression will obtain the coefficients A, B, and C for an equation which algebraically approximates the above tabulated measured natural frequency data in the form $$f_c = C + A * \text{tipping amount} + B * m_c \qquad \text{(Equation 3)}$$

Using the above equation and the measured data, frequency, $f_c$, is plotted in the graph of FIG. 9 as the Y coordinate and moment, $m_c$, is plotted as the X coordinate. B represents the slope of the curves, shown graphically when the data are graphed as in FIG. 9. The slope, B is equal, in the preferred embodiment, to the difference between two frequencies for a selected tipping amount divided by the difference between two moments for the effective shaft lengths of the same pair of measured frequencies. In the examples shown in FIG. 9, this is represented as $$B = \frac{F_2 - F_1}{M_2 - M_1}. \qquad \text{(Equation 4)}$$

The constant, A is a function of the spacing between each curve on the graph of FIG. 9. Since the graph of FIG. 9 need not be constructed in order to obtain the constant A, A is obtained either by measurement of the spacing on the graph in combination with other calculations, or (as is preferred), as follows. A times a given tipping amount is equal to the difference in frequency (along the Y axis in FIG. 9) between two curves spaced apart by that tipping amount for the same effective shaft length. Therefore, A is equal to the difference in frequency between two data points for different tipping amounts at the same effective shaft length divided by the difference in the amount of tipping between the two data points. For example, in the graph of FIG. 9, the difference in frequency between the two data points P1 and P2 in the lower right hand end of the upper two curves is shown to be 4.7665 cycles per minute. The difference in tipping amount between those same two curves is 0.75 inches. Therefore, A is calculated as 4.7665 divided by 0.75 which equals 6.3553.

Once the constants A and B are obtained for the replica shaft which represents a category of shaft types, these values will be used later to calculate the tipping amount of the clubs which are custom made for a particular golfer. The constants A and B represent the physical characteristics of the type of shaft which the replica shaft represents. The constants A and B are preferably obtained for each type of shaft available to the golf club maker and this information is preferably stored for use later in combination with other constants and predetermined frequency and moment amounts.

When it becomes time to manufacture a club for a particular golfer, a shaft having predetermined A and B values is taken from the club maker's inventory. The shaft is of a particular type which the golfer desires for a particular club in a set. Each shaft in a golf club maker's inventory will typically have been pretested (by a test which is standard in the industry) by the shaft manufacturer to obtain a natural frequency of oscillation, $f_c$, for a selected moment, $m_c$. The test involves attaching a weight of specified mass to the shaft, clamping the shaft by the grip end and vibrating the shaft to measure the natural frequency of oscillation. This natural frequency is typically indicated on the shaft by a printed adhesive sticker, an engraving or otherwise. The constant, C is then calculated for that inventory shaft by $$C = f_c - B * m_c. \qquad \text{(Equation 5)}$$

The constant C indicates the amount of stiffness or natural frequency by which the inventory shaft differs from the replica shaft which represented that inventory shaft during the testing to obtain the constants A and B. The constant C corrects any stiffness variations between the replica shaft and the inventory shaft and is used subsequently in an equation for calculating the tipping amount.

Once the constants A and B are obtained for a particular shaft type and the constant C is obtained for a particular inventory shaft of that type, the tipping amount necessary for that particular inventory shaft can be calculated by the following equation:

$$\text{tipping amount} = (f_g - C - B * m_g) \div A.$$

The constants A, B and C have been obtained as described above, and the variables $f_g$ and $m_g$ represent the desired natural frequency and the desired moment, respectively, that the golfer's golf club should have once the golf club maker makes it. The desired natural frequency, $f_g$, is obtained in the present invention as described above in the original disclosure of the patent application, although it can be obtained in any manner for use in the present invention. The moment, $m_g$, is obtained by calculation, since the overall length of the golf club is known and the weight of the club head is known.

The tipping amount is calculated using the above equation, and the next step is to remove a length of the shaft at the narrow, tip end of the shaft equal to the tipping amount calculated. If the tipping amount calculated, once removed from the shaft, will leave the shaft shorter than the desired final shaft length, then a stiffer shaft should be substituted.

If the frequency is too high for a particular shaft being tried, a less stiff shaft will be needed. For example, if a tipping amount calculated has a negative value (i.e. tipping must be added), then a less stiff shaft should be substituted. Furthermore, if the shaft, subsequent to having the tipping amount removed from it, exhibits poor performance characteristics, then a different type or initial length of club shaft may also have to be used.

As the final step in the trimming process, an amount is removed from the opposite, grip end of the shaft (if necessary) which will leave the shaft at the length which was initially desired. The shaft is then assembled with the club head and other golf club parts to complete the golf club.

In the preferred embodiment, the method of the present invention is used to construct a plurality of golf clubs making up a set of golf clubs. Since golf clubs in a set vary in length, club head weight and shape, and other characteristics, the present invention can be used to construct golf clubs having these various characteristics in a set, each individual golf club matched to the golfer's swing.

It may, in the future, become common industry practice for each type of golf club shaft to be pretested individually or as a category prior to sale to club makers so that the constants A, B, and C for each shaft may be predetermined and given to the golf club makers. In this case, the only steps necessary to custom trim a golf club shaft include calculating the tipping amount using Equation 6, removing the tipping amount length from the narrow, tip end of the shaft and removing a length from the grip end of the shaft.

Another method of trimming golf club shafts in order to arrive at a shaft having the length appropriate for the individual golfer's golf club and a natural frequency for the golfer's golf club is also contemplated in the present invention. However, this method requires trial and error rather than an equation like Equation 6 in the tipping amount determination.

The natural frequency of oscillation, $f_g$, of the golfer's golf club is predetermined as described in the original disclosure or otherwise, and the golf club maker estimates the amount of tipping necessary to form a shaft having the desired natural frequency for that golfer. The estimated tipping amount is then removed from the narrow tip end of the shaft.

The actual natural frequency of oscillation, $f_c$, of the tipped shaft is measured by the shaft being rigidly mounted by its grip end in a machine like the machine 50 shown in FIG. 7, setting the effective length of the shaft equal to the appropriate length for the individual golfer's golf club. A weight preferably equal to the weight of the club head is next attached to the narrow, tip end of the shaft. The natural frequency of oscillation, $f_c$, of the shaft is measured by displacing and releasing the tip end of the shaft and measuring the frequency of oscillation of the tip end along an arcuate path about the grip end. If the frequency of oscillation, $f_c$, of the shaft is equal to the desired natural frequency, $f_g$, for the particular golfer, a length of the grip end of the shaft is removed to make the shaft equal to the length desired for the final shaft. The amount removed from the grip end is equal to the initial length minus both the tipping amount and the desired final length.

If the frequency of oscillation measured is less than the desired frequency for the particular golfer, the steps of estimating the tipping amount necessary, removing the tipping amount, and measuring the frequency of the shaft are repeated until the measured frequency of oscillation equals or is acceptably close to the frequency for the particular golfer. If the measured frequency becomes substantially higher than the desired frequency of oscillation for the golfer, the shaft will most likely need to be discarded since it will probably not be possible to decrease the frequency while keeping the same effective shaft length. This is due to the tapered shape of the golf club shaft and the fact that removing parts of the tip end increases the frequency of a given effective shaft length. If the desired shaft length at a desired frequency cannot be achieved with a particular shaft, a shaft having greater or less stiffness will need to be substituted. A shaft of greater stiffness is necessary when the shaft initially selected has to have so much removed from the tip to achieve the desired frequency that the shaft is too short for the golfer. A less stiff shaft is necessary when the shaft initially selected has a frequency that is too high for the golfer before any part of the tip end is removed.

While certain preferred embodiments of the present invention have been disclosed in detail, it is to be understood that various modifications may be adopted without departing from the spirit of the invention or scope of the following claims.

I claim:

1. A method for custom trimming a golf club shaft at locations which form the shaft with both a length appropriate for an individual golfer's golf club and a natural frequency of oscillation, $f_g$, in a cantilevered beam mode of oscillation in which a narrow end of the shaft oscillates along an arcuate path about a grip end of the shaft, wherein $f_g$ has been predetermined for that golfer's golf club, the method comprising:

(a) measuring the natural frequency of oscillation, $f_c$, of a replica shaft representative of a specified type of shaft at a plurality of different effective shaft lengths, and at a plurality of different tipping amounts for each effective shaft length over a range of effective shaft lengths and a range of tipping amounts;

(b) calculating the moment, $m_c$, of the replica shaft for each of said plurality of different effective shaft lengths;

(c) performing a linear regression on the frequency measurements to get the coefficients A, B and C for an equation algebraically approximating the measured natural frequency data in the form $$f_c = C + A * \text{tipping amount} + B * m_c;$$

(d) selecting, from inventory, a shaft which has been measured to determine its natural frequency of oscillation, $f_c$, at a selected moment;

(e) calculating the tipping amount of the inventory shaft from the equation $$\text{tipping amount} = (f_g - C - B * m_g) \div A$$

where $m_g$ is the desired moment of the golfer's golf club;

(f) removing a length of the narrow end of the inventory shaft equal to the tipping amount; and (g) removing a length of the grip end of the inventory shaft equal to an initial shaft length minus both the tipping amount and the desired final shaft length.

2. A method for custom trimming a golf club shaft at locations which form the shaft with both a length appropriate for an individual golfer's golf club and a natural frequency of oscillation, $f_g$, in a cantilevered beam mode of oscillation in which a narrow end of the shaft oscillates along an arcuate path about a grip end of the shaft, wherein $f_g$ has been predetermined for that golfer's golf club, the method comprising:

(a) measuring the frequency of oscillation, $f_c$, of a replica shaft representative of a specified type of shaft at a plurality of different effective shaft lengths and a plurality of different tipping amounts for each effective shaft length over a range of shaft lengths and a range of tipping amounts;

(b) calculating the moment, $m_c$, of the replica shaft for each of said plurality of different effective shaft lengths;

(c) calculating the quotient, A of (i) the difference between the measured frequencies for a pair of different tipping amounts at the same effective replica shaft length, and (ii) the difference between the same pair of tipping amounts;

(d) calculating the quotient, B of (i) the difference between a pair of measured frequencies for a selected tipping amount and (ii) the difference between two moments for the effective replica shaft lengths at the same pair of measured frequencies;

(e) selecting, from inventory, a shaft which has been measured to determine its natural frequency of oscillation, $f_c$, for a selected moment, $m_c$, and then calculating the constant, C for the inventory shaft, wherein $$C=f_c-B*m_c;$$

(f) calculating the tipping amount for the inventory shaft, wherein $$\text{tipping amount}=(f_g-C-B*m_g)\div A$$

where $m_g$ is the desired moment of the golfer's golf club;

(g) removing a length of the narrow end of the inventory shaft equal to the tipping amount; and (h) removing a length of the grip end of the inventory shaft equal to the initial shaft length minus both the tipping amount and the desired final shaft length.

3. A method in accordance with claim 2, wherein data obtained for frequency, $f_c$, and moment, $m_c$, are graphed, forming a curve for each tipping amount and a plurality of curves for each shaft type.

4. A method in accordance with claim 3, wherein a plurality of curves are graphed for a plurality of different shaft types.

5. A method in accordance with claim 3, wherein the quotient, A is equal to (i) the difference between frequency measurements for a pair of different tipping amounts at the same effective replica shaft length divided by (ii) the difference between the same pair of tipping amounts.

6. A method in accordance with claim 5 wherein the quotient, B is equal to (i) the difference between a pair of frequency measurements for a selected tipping amount divided by (ii) the difference between two moments for the same effective replica shaft lengths as the pair of frequency measurements.

7. A method in accordance with claim 6, wherein the method is used to locate the cuts on a plurality of golf club shafts for forming a shaft of desired characteristics for each golf club in a set of clubs.

8. A method for custom trimming a golf club shaft at locations which form the shaft with both a length appropriate for an individual golfer's golf club and a natural frequency of oscillation, $f_g$, in a cantilevered beam mode of oscillation in which a narrow end of the shaft oscillates along an arcuate path about a grip end of the shaft, wherein $f_g$ has been predetermined for that golfer's golf club, and wherein the constants A and B have been predetermined for a replica shaft representative of a specified type of shaft and the constant C has been predetermined for an inventory shaft, the method comprising:

(a) calculating the tipping amount of the inventory shaft, wherein $$\text{tipping amount}=(f_g-C-B*m_g)\div A$$

where $m_g$ is the desired moment of the golfer's golf club;

(b) removing a length of the narrow end of the inventory shaft equal to the tipping amount; and (c) removing a length of the grip end of the inventory shaft equal to the initial shaft length minus both the tipping amount and the desired final shaft length.

9. A method for custom trimming a golf club shaft at locations which form the shaft with both a length appropriate for an individual golfer's golf club and a natural frequency of oscillation, $f_g$, in a cantilevered beam mode of oscillation in which a narrow end of the shaft oscillates along an arcuate path about a grip end of the shaft, wherein $f_g$ has been predetermined for that golfer's golf club, the method comprising:

(a) estimating the tipping amount necessary to form a shaft having the desired natural frequency of oscillation, $f_g$;

(b) removing a length of the narrow end of the shaft equal to the estimated tipping amount;

(c) measuring the natural frequency of oscillation, $f_c$, of the shaft by (i) attaching a weight to the narrow end of the shaft, (ii) rigidly mounting a portion of the grip end of the shaft with the distance between the center of the weight and the distal, mounted portion of the grip end being the appropriate length for the individual golfer's club, (iii) displacing and subsequently releasing the narrow end and (iv) measuring the frequency of the oscillations of the narrow end along the arcuate path about the grip end;

(d) repeating the steps of estimating the tipping amount, removing a length of the narrow end of the shaft and measuring the natural frequency, $f_c$, if the measured natural frequency of oscillation, $f_c$, is substantially less than the desired natural frequency, $f_g$, of the golfer's golf club, wherein the repeated measuring step further comprises rigidly mounting the shaft at a portion of the grip end spaced from the previous mounting portion a distance equal to the amount removed from the shaft to maintain the distance between the center of the weight and the distal, mounted portion of the grip end as the appropriate length for the individual golfer's golf club; and (e) removing a length of the grip end of the shaft equal to the initial shaft length minus both the tipping amount and the desired final shaft length.

10. A method in accordance with claim 9, wherein rigidly mounting the shaft further comprises firmly clamping the grip end.

* * * * *